United States Patent [19]

Joshi

[11] 4,169,066

[45] Sep. 25, 1979

[54] PROCESS OF INCORPORATING POLY(ETHYLENE OXIDE) INTO SOAP

[75] Inventor: David P. Joshi, Plainfield, N.J.

[73] Assignee: Colgate-Palmolive Company, New York, N.Y.

[21] Appl. No.: 816,119

[22] Filed: Jul. 15, 1977

[51] Int. Cl.[2] ..... C11D 9/22; C11D 15/04

[52] U.S. Cl. ..... 252/132; 252/90; 252/134; 252/174; 252/367; 252/368; 424/177; 424/359; 264/75; 427/212

[58] Field of Search ..... 252/90, 132, 134, 174, 252/367, 368; 424/177, 359; 264/75; 427/212

[56] References Cited

U.S. PATENT DOCUMENTS

| | | | |
|---|---|---|---|
| 3,179,596 | 4/1965 | Farrar et al. | 252/132 X |
| 3,576,749 | 4/1971 | Megson et al. | 252/132 |
| 3,598,746 | 8/1971 | Kuniecki et al. | 252/132 |
| 3,835,058 | 9/1974 | White | 252/174 X |
| 3,944,663 | 3/1976 | Weiss et al. | 252/174 X |

FOREIGN PATENT DOCUMENTS 0042734 1/1966 German Democratic Rep. .

OTHER PUBLICATIONS

Ency of Chemical Tech., (2nd ed.), vol. 18, pp. 415–432.
Polyox, Water-Soluble Resins-Union Carbide.
Davidson et al., "Water Soluble Resins", Reihold Pub. Co., N.Y., N.Y., 1962, pp. 197–198.

*Primary Examiner*—Mayer Weinblatt
*Attorney, Agent, or Firm*—Herbert S. Sylvester; Murray M. Grill; Norman Blumenkopf

[57] ABSTRACT

High molecular weight poly(ethylene oxide) is incorporated into soap by first forming a blend of poly(ethylene oxide) and molten higher fatty acids, preferably containing water.

7 Claims, No Drawings

PROCESS OF INCORPORATING POLY(ETHYLENE OXIDE) INTO SOAP

This invention relates to the making of soap bars containing high molecular weight poly(ethylene oxide). Soap bars containing this polymer have been made commercially by adding powdered poly(ethylene oxide) to soap chips in a soap amalgamator; such addition requires special precautions in order to avoid formation of specks in the final bar. The use of high molecular weight poly(ethylene oxide) ("Polyox resin") in synthetic detergent bars, which may contain some soap, has also been described and it has been suggested that "the resin may be melted in combination with soap, detergent base, or other ingredients and then other material incorporated into the melt" (Davidson and Sittig "Water Soluble Resins" pub. 1962, pages 197–8). When I attempted to incorporate about 2% powdered poly(ethylene oxide) into a neat soap containing about 30% water ("kettle soap") I obtained a mixture which was lumpy and poorly dispersed and not pumpable.

I have found that a superior blend is obtained by incorporating the poly(ethylene oxide), desirably in powder form, into a melt of all, or a portion of, the higher fatty acids which are to be used for superfatting the soap. Best results are obtained when this blend also contains a minor amount of water. As will be seen in Example 1 below, the presence of the water has a marked effect on the nature of the blend of fatty acid and high molecular weight poly(ethylene oxide), significantly decreasing its viscosity; the presence of the water also tends to opacify the blend which may indicate that a water-in-oil type of dispersion is formed. The water-containing blend can be pumped readily; its viscosity is well below the upper viscosity limit (which is about 7,000 or 8,000 centipoises) of materials that can be handled readily by ordinary reciprocating pumps. It can thus be easily pumped into admixture with the kettle soap. The poly(ethylene oxide)-containing soap bars made by this procedure have outstanding properties; they lather well, have an especially pleasant feel during and after use, have good slough resistance and resistance to wet-cracking.

The following examples are given to illustrate this invention further. In this application all proportions are by weight unless otherwise specified.

EXAMPLE 1

(a) 5 parts of commercial stearic acid (m.p. 54° C.) and 5 parts of coco fatty acids (m.p. 25° C; iodine value 6) are melted together at a temperature of about 102° C. One part of powdered high molecular weight poly(ethylene oxide) ("Polyox WSR N-750" m.p. about 65° C.) is added thereto with stirring. The viscosity of the mixture at 102° C. is about 750 cps, at 88° C. it is about 4,000 cps and at 54° C. it is about 5,000 cps. (as determined with a Brookfield viscosimeter).

One more part of the same Polyox is then added with stirring. The viscosity of the mixture is about 18,000 cps at 94° C., about 19,000 cps at 88° C., about 33,500 cps at 66° C. and about 42,500 cps at 54° C.

Then 0.5 part of lanolin is added with stirring. The resulting blend now has a viscosity of about 15,000 cps at 94° C. and a similar viscosity at 70° C.

Next 1 part of water is added. As a result, the formerly clear blend becomes cloudy or opaque. Its viscosity is about 5,000 cps at 77° C., about 4,000 cps at 71° C. and about 3,250 cps at 50 to 63° C.

Thereafter an additional 1 part of water is added with stirring. The resulting blend has a viscosity of about 2,250 cps at 84° C., 1,500 cps at 81° C., 930 cps at 71° C., 470 cps at 67° C., 234 cps at 60° C. and 114 cps at 52° C.

Next 2.5 parts of a solution of sodium caseinate (containing 20% casein) is added. The resulting blend is white. Its viscosity is about 2,900 cps at 81° C., 2,520 cps at 71° C., 1,700 cps at 66° C. and 1,800 cps at 60° C.

It will be seen that the addition of the water gives a blend whose viscosity at, say, 70° C. is greatly decreased (e.g. to well below half its value before the addition of the water). Also the blends containing water show a remarkable decrease in viscosity with decrease in temperature (e.g. when temperature is reduced, from 70° or 80° C., by 10° C. the viscosity drops by well over 10%).

EXAMPLE 2

The final product of Example 1 is pumped at a temperature of about 60°–85° C. into a mixing vessel containing kettle soap (at 70° C.) in such proportions that the resulting mixture contains about 75 parts of the sodium soap (expressed as anhydrous soap), 4.5 parts of the added stearic acid, 4.5 parts of the added coco fatty acids and 1.8 parts of the poly(ethylene oxide). The kettle soap is made by saponifying a 50/50 mixture of coconut oil and tallow with sodium hydroxide solution, extraction of resultant glycerine, "washing" with electrolyte solution and removal of high electrolyte nigre soap layer, all as is conventional in the manufacture of kettle soaps; it contains about 27–32% (e.g. 30%) water, up to about 1% (e.g. 0.05%) glycerol, up to about 0.3% (e.g. 0.1%) NaOH, up to about 1% (e.g. 0.7%) NaCl. The ingredients are stirred together for a few minutes and the mixture is then formed into dried soap chips containing about 5 to 15% (e.g. 10%) moisture; one suitable conventional way to do this is to pump the hot soap mixture onto a chilled roll forming a thin film on the roll, slicing the film into chips or ribbons and then drying the chips or ribbons. The chips are then blended with color and perfume (e.g. 0.7% $TiO_2$ and 1.5% perfume) in conventional manner in a soap amalgamator at about room temperature, then milled to homogenize them (e.g. at a temperature of about 15° to 35° C.), then extruded into a bar form by means of a conventional soap plodder (e.g. at a temperature of about 20°–50° C. (e.g. 40° C.), then cut into cakes); the surfaces of the cakes are cooled and the cakes are pressed into the desired shapes (e.g. in a pin-die press).

EXAMPLE 3

10 parts of stearic acid are melted, 2 parts of the poly(ethylene oxide) of Example 1 are added thereto, followed by 1.5 parts of water, while the mixture is stirred and maintained at about 70°–90° C.

EXAMPLE 4

Example 3 is repeated except that coco fatty acids are used in place of stearic acid.

In the water-containing blend of poly(ethylene oxide) and higher fatty acids there are preferably about 2 to 20 (more preferably about 4 to 8) parts of the fatty acids per part of poly(ethylene oxide) and about 0.5 to 5 (more preferably about 1 to 2) parts of water per part of poly(ethylene oxide). It is preferred that the amount of moisture in the ingredients added to the kettle soap be such that the moisture:soap ratio be maintained in the range of about 27:73 to 32:68.

The higher fatty acids may be of the type conventionally employed for superfatting of soaps, typically having about 8 to 20 carbon atoms. Examples of higher fatty acids are given, for instance, in U.S. Pat. No. 3,576,749.

The high molecular weight poly(ethylene oxide) has an average molecular weight of at least about 100,000. Examples of such compounds are those sold by Union Carbide Company under the trademark "polyox". These polymers are nonionic materials, soluble in water and their molecular weights range from about 100,000 to about 5,000,000 or more. It is preferred to employ polymers having average molecular weights below 1,000,000, more preferably not above about 600,000 such as about 300,000 to 400,000. For the material having an average molecular weight of about 300,000 a proportion in the neighborhood of 2% has given excellent results. This 300,000 molecular weight material (sold as Polyox WSR N-750) has a viscosity at 25° C., for a 2% aqueous solution, of about 40 centipoises (Brookfield Spindle No. 1 at 10 rpm); for a 5% solution this viscosity is about 600–1000 centipoise. Use of say 2% of extremely high molecular weight poly(ethylene oxide), e.g. of 4,000,000 average molecular weight, in a bar causes the lather to be pituitous, which is less desirable. According to the manufacturer the Polyox materials typically have a pH of about 10 (e.g. in 5% solution). Soap typically has a pH in 1% aqueous solution of about 10 (e.g. 10.2), while the superfatted soaps generally have pHs somewhat below 10.

The poly(ethylene oxide) is generally supplied as a powder and typically has the following particle size distribution when a sample thereof is screened through a series of sieves, expressed as weight percent retained on the indicated Sieve No. screen (U.S. Sieve Series): No. 20–5.2%; No. 40–31.2%; No. 60–20.7%; No. 100–16.7% and through No. 100-balance. It is often preferable to use a finer particle size poly(ethylene oxide) having the following distribution as measured above: No. 20–0.3%; No. 40013%; No. 60–13%; No. 100–13.9% and through No. 100-balance.

The process of this invention finds its greatest utility when the amount of poly(ethylene oxide) introduced into the neat soap is at least about ½% (based on the weight of the final soap bar). Preferably this amount is in the range of about 1 to 4%, most preferably about 1½ to 2½ or 3%.

The processes described herein (and the blends produced by that process) are particularly suitable for the manufacture of superfatted toilet soap bars as described in more detail in my copending application Ser. No. 816,123 filed on the same date as the present application and entitled "Bar Product," whose entire disclosure is incorporated herein by reference. As disclosed therein, it is preferable to dry the soap to a moisture content below about 12% for easier processing; drying to a moisture content within the range of about 5 to 18% is within the broader scope of this invention.

It is within the broader scope of the invention to use a process in which the poly(ethylene oxide) is incorporated into the soap in a plurality of stages, with one portion (such as about half or two thirds of the total polymer) being incorporated into the neat soap and the other portion being added to the soap chips in the amalgamator. In order to reduce the tendency to form specks it is desirable to add the polymer to the amalgamator in the form of very finely ground material (such as material of which 98% passes through a no. 100 screen (U.S. Sieve Series) and to thoroughly distribute the powdered polymer on the surfaces of the chips in the amalgamator before adding the other ingredients such as pigment. When a significant proportion of the total polymer is incorporated into the neat soap, the soap is less sticky during the incorporation of the balance of the polymer in the amalgamator and the amalgamation process may be accomplished more easily and with less power.

It is understood that the foregoing detailed description is given merely by way of illustration and variations may be made therein without departing from the spirit of the invention.

I claim:

1. Process for incorporation of at least about 0.5 wt. % of poly(ethylene oxide) of molecular weight 100,000 to 5,000,000 into a toilet bar having a basis of soap as substantially the sole detergent comprising the steps of preparing a blend of said poly(ethylene oxide) in about 2 to 20 parts, per part by weight of said poly(ethylene oxide), of molten higher fatty acid of about 8 to 20 carbon atoms, mixing said blend with neat soap containing about 30% moisture, drying the resulting mixture to a moisture content of about 5 to 18 wt. %, and thereafter shaping the mixture into a superfatted toilet soap bar with improved lather and feel properties.

2. Process as in claim 1 in which said poly(ethylene oxide) has a molecular weight of about 300,000 to 400,000.

3. Process as in claim 1 in which said blend contains a minor proportion of dispersed water sufficient to decrease the viscosity of said blend.

4. Process as in claim 3 in which the water is present as a dispersed phase.

5. Process as in claim 4 in which said blend contains about 0.5 to 5 parts of water per part of said poly(ethylene oxide).

6. Process as in claim 5 in which said blend contains about 4 to 8 parts of said fatty acids and about 1 to 2 parts of water per part of said poly(ethylene oxide).

7. Process as in claim 5 in which said poly(ethylene oxide) has a molecular weight of about 300,000 to 400,000.

* * * * *